US008690046B2

(12) United States Patent
Plourde

(10) Patent No.: US 8,690,046 B2
(45) Date of Patent: Apr. 8, 2014

(54) SELF-MATING ZIPPER ON CARTON

(75) Inventor: Eric Plourde, Frankfort, IL (US)

(73) Assignee: Illinois Tool Works Inc., Glenview, IL (US)

( * ) Notice: Subject to any disclaimer, the term of this patent is extended or adjusted under 35 U.S.C. 154(b) by 383 days.

(21) Appl. No.: 13/032,986

(22) Filed: Feb. 23, 2011

(65) Prior Publication Data

US 2011/0266336 A1 Nov. 3, 2011

Related U.S. Application Data

(60) Provisional application No. 61/329,326, filed on Apr. 29, 2010.

(51) Int. Cl.
*B65D 43/22* (2006.01)
*B65D 5/02* (2006.01)

(52) U.S. Cl.
USPC ..... 229/125.015; 229/125.33; 229/125.35

(58) Field of Classification Search
USPC ..... 229/125.015, 125.05, 125.33, 125.34, 229/125.35; 383/61.2, 62.3, 63, 64, 65, 97
See application file for complete search history.

(56) References Cited

U.S. PATENT DOCUMENTS

| | | | | |
|---|---|---|---|---|
| 2,305,371 | A * | 12/1942 | Yates | 229/125.01 |
| 4,139,119 | A * | 2/1979 | McLaren | 229/125.01 |
| 4,332,344 | A * | 6/1982 | Strodthoff | 383/63 |
| 4,617,683 | A | 10/1986 | Christoff | |
| 4,691,373 | A | 9/1987 | Ausnit | |
| 4,720,015 | A * | 1/1988 | Brauner | 229/125.34 |
| 5,024,537 | A | 6/1991 | Tilman | |
| 6,063,416 | A | 5/2000 | Teasdale et al. | |
| 6,110,512 | A | 8/2000 | Teasdale | |
| 6,533,456 | B1 * | 3/2003 | Buchman | 383/63 |
| 6,908,422 | B2 | 6/2005 | Ichikawa et al. | |
| 7,160,029 | B2 | 1/2007 | Bein | |
| 7,207,716 | B2 | 4/2007 | Buchanan | |
| 7,524,111 | B1 | 4/2009 | Williams | |
| 2003/0111521 | A1 | 6/2003 | Holmes | |
| 2005/0194386 | A1 | 9/2005 | Shai | |
| 2011/0017814 | A1 * | 1/2011 | Belko et al. | 383/61.3 |

FOREIGN PATENT DOCUMENTS

| | | |
|---|---|---|
| JP | 2002104511 | 4/2002 |
| WO | 2011/043894 | 4/2001 |

OTHER PUBLICATIONS

U.S. Appl. No. 12/922,537, Sep. 14, 2010, Howell et al.

* cited by examiner

*Primary Examiner* — Gary Elkins
(74) *Attorney, Agent, or Firm* — McCarter & English, LLP

(57) ABSTRACT

The present disclosure relates to rigid or semi-rigid cartons with zipper-type reclosable elements, particularly self-mating zippers. The cartons can be formed from blanks which have a self-mating zipper on the inside of the carton. Additionally, the zipper can be attached to a flexible film which is, in turn, attached to the package.

18 Claims, 2 Drawing Sheets

SELF-MATING ZIPPER ON CARTON

This application claims priority under 35 U.S.C. §119(e) of provisional patent application Ser. No. 61/329,326, filed on Apr. 29, 2010, the contents of which are incorporated by reference in their entirety.

BACKGROUND OF THE DISCLOSURE

1. Field of the Disclosure

The present disclosure relates to rigid or semi-rigid cartons with zipper-type reclosable elements, particularly self-mating zippers.

2. Description of the Prior Art

The art of semi-rigid or rigid containers with a polymeric reclosable header has been developed. Manufacturing such a package typically requires two webs of film, or a single web folded lengthwise, with mated opposing zipper halves typically attached to the inside facing surfaces of the web. This flexible portion must be unfolded and wrapped around a box blank that has been folded and glued or otherwise sealed together at a lap seam. The box must be flattened in a specific way so that extra folds are made in the center of the two sides of the box, which is not typical of many other types of prior art box construction.

A prior art container is disclosed in application Ser. No. 12/922,537 entitled "Carton with Plastic Reclosable Header" filed by Howell et al. on Sep. 14, 2010.

Other prior art regarding similar containers includes those disclosed in U.S. Pat. No. 7,524,111 entitled "Rigid-Bottomed Resealable Bag with Handles", issued on Apr. 28, 2009 to Williams; U.S. Pat. No. 7,207,716 entitled "Flexible Container Having Flat Walls", issued on Apr. 24, 2007 to Buchanan; U.S. Pat. No. 7,160,029 entitled "Enclosure for Resealing a Package and Method Therefor", issued on Jan. 9, 2007 to Bein; U.S. Pat. No. 6,908,422 entitled "Reclosable Packaging Bag and Method for Manufacturing Same", issued on Jun. 21, 2005 to Ichikawa et al.; U.S. Pat. No. 6,110,512 entitled "Package and Merchandiser", issued on Aug. 29, 2000 to Teasdale; U.S. Pat. No. 6,063,416 entitled "Procedure and Package to Enable Peg Display of Food Pouch in Tent-Style Paperboard Carton", issued on May 16, 2000 to Teasdale et al.; U.S. Pat. No. 4,691,373 entitled "Zipper Closure with Unitary Adhesive Cover Sheet", issued on Sep. 1, 1987 to Ausnit; and U.S. Published Patent Application No. 2005/0194386, entitled "Zipper Box Covers" published on Sep. 8, 2005 for Shai; and Japanese Patent No. 2002104511 entitled "Bag-in-Carton", published on Apr. 10, 2002 for Makoto et al.

SUMMARY AND OBJECTS OF THE DISCLOSURE

It is therefore an object of the present disclosure to provide a rigid or semi-rigid carton with zipper-type reclosable elements, wherein the manufacturing process is simplified, typically including a reduction in the number of folds required in the rigid or semi-rigid carton.

This and other objects are attained by the present disclosure by attaching a self-mating zipper profile directly to the top edge of the carton while the carton is in its flat unfolded state. The zipper can be attached in segments or as a continuous strip. Alternatively, a strip of flexible film with an integral or attached self-mating zipper profile can be attached to the top edge of a box blank whereby the zipper profile is positioned above the box blank or rigid portion of the container.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
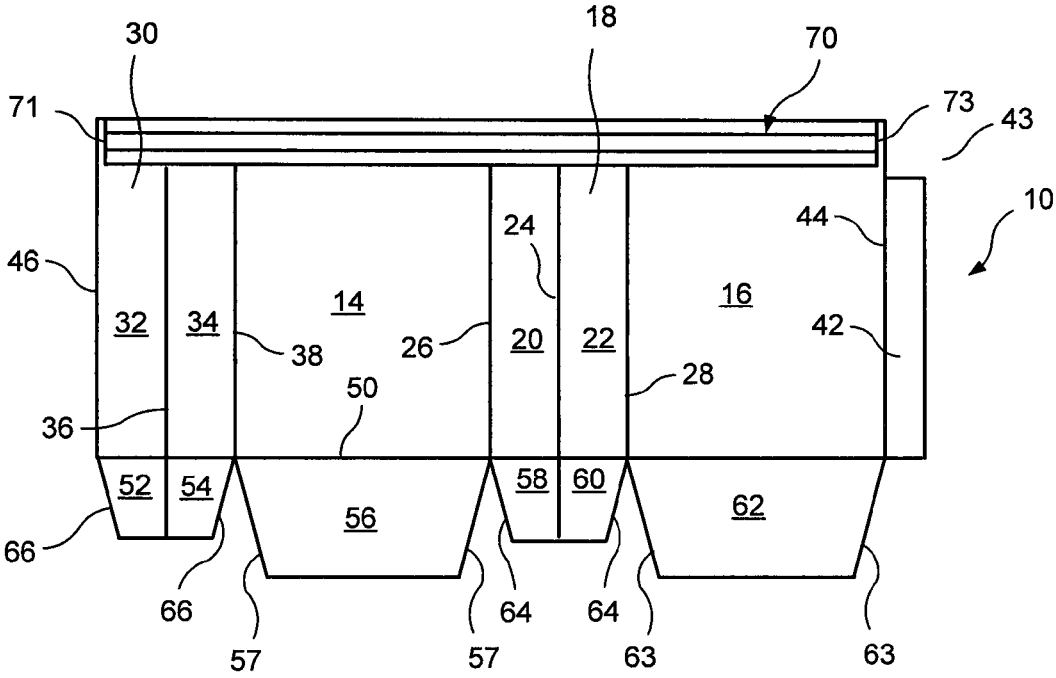
FIG. 1 is a plan view of a first embodiment of the present disclosure.
Figure 2:
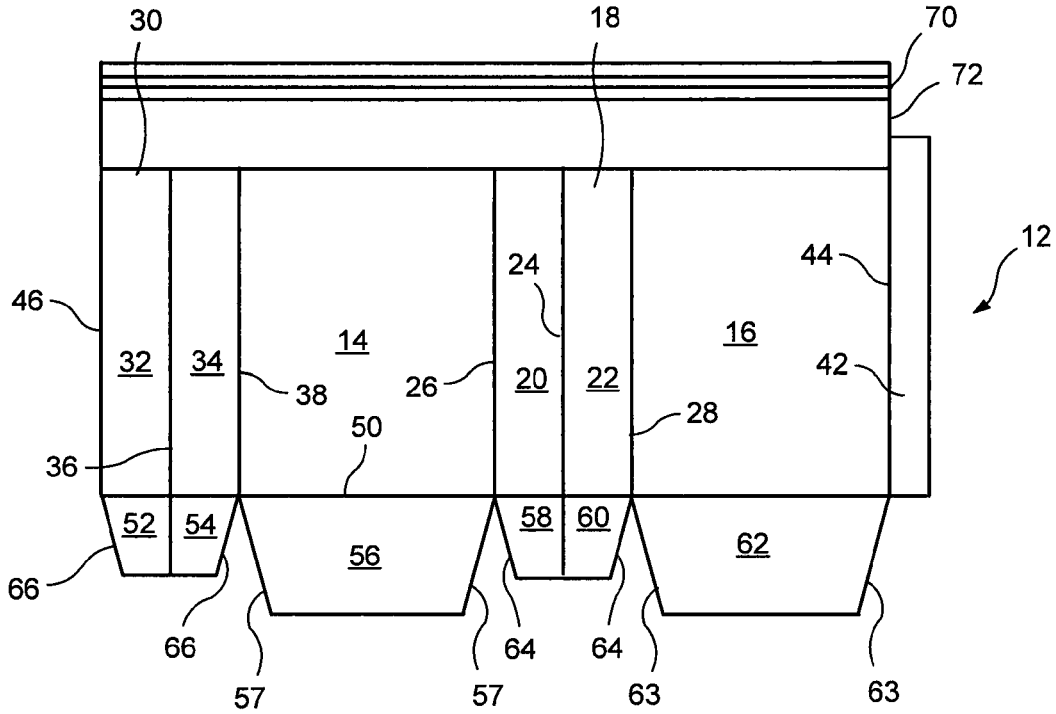
FIG. 2 is a plan view of a second embodiment of the present disclosure.
Figure 3:
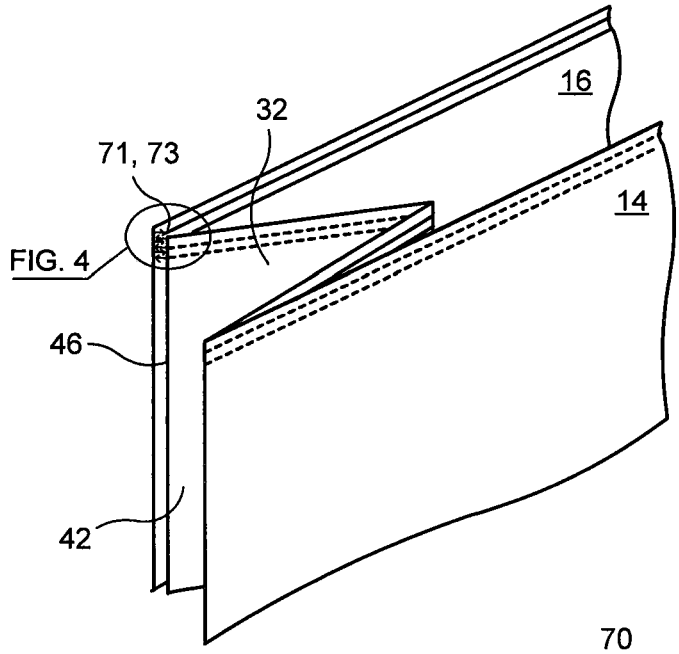
FIG. 3 is a perspective view showing the sealing together of opposite ends of the zipper or closure.
Figure 4:
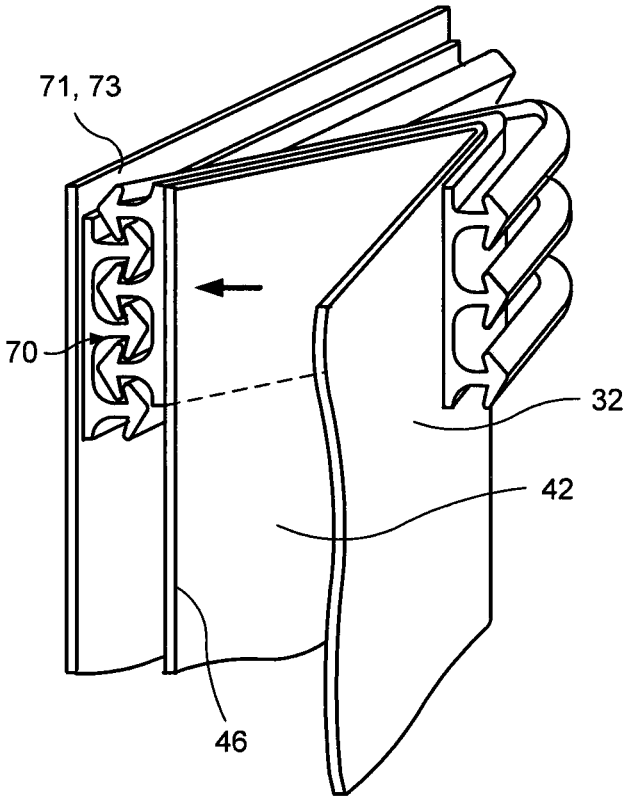
FIG. 4 is a partially exploded view showing the interlocking of opposite ends of the zipper or closure.

Referring now to the drawings in detail wherein like numerals indicate like elements throughout the several views, one sees that FIGS. 1 and 2 disclose blanks 10, 12, respectively, with similar configurations of the rigid or semi-rigid portions. The blanks 10, 12 both include rigid or semi-rigid portions which are typically made from a single piece of paper, cardboard, fiberboard, chipboard, plastic or similar material. Blanks 10, 12 include front panel 14 and rear panel 16 (the "front" and "rear" characteristics are arbitrary and used with respect to the illustrated embodiments) which are separated by first gusset (or panel) 18 which includes first front gusset wall 20 and first rear gusset wall 22 separated by first gusset fold 24. Likewise, front panel 14 is joined to first front gusset wall 20 by first front fold 26 and rear panel 16 is joined to first rear gusset wall 22 by first rear fold 28. Likewise, second gusset (or panel) 30 includes second rear gusset wall 32 and second front gusset wall 34, separated by second gusset fold 36 with second front gusset wall 34 joined to front panel 14 by second front fold 38. Tab 42 is joined to rear panel 16 by second rear fold 44, and includes a notch 43 to prevent interference with closure 70. As shown in FIGS. 3 and 4, tab 42 is used to overlap and join to the distal edge 46 of second rear gusset wall 32 thereby forming the resulting container, with a resulting storage volume. In some embodiments, tab 42 may extend from or be incorporated into second gusset (or panel) 30. In some embodiments, the first and second panels 18 do not include the gusset structure and therefore do not include first and second gusset folds 24, 36.

Lower horizontal fold 50 extends across the blanks 10, 12, perpendicular to folds 24, 26, 28, 36, 38 and 44, thereby defining second rear gusset wall floor panel 52, second front gusset wall floor panel 54, front panel floor panel 56, first front gusset wall floor panel 58, first rear gusset wall floor panel 60 and rear panel floor panel 62. First front gusset wall floor panel 58 and first rear gusset wall floor panel 60 are joined by an extension of first gusset fold 24. Similarly, second front gusset wall floor panel 54 is joined to second rear gusset wall floor panel 56 by an extension of second gusset fold 36. Typically, the front panel floor panel 56 and the rear panel floor panel 62 have inclined lateral walls, 57, 63, respectively. Similarly, the combination of first front and rear floor panels 58, 60 and of second front and rear floor panels 52, 54 have inclined lateral walls 64, 66, respectively. Other designs of the various floor panels may be used for different applications. Typically, after the tab 42 has been overlapped and joined to the distal edge of second rear gusset wall 32, thereby forming the storage volume of the container, floor tabs 52, 54, 56, 58, 60 and 62 are folded inwardly and glued with adhesive or otherwise secured to form the floor of the resulting package.

The blank 10 shown in FIG. 1 includes a closure 70, such as, but not limited to, a self-mating zipper profile in a continuous one-piece configuration, attached to what will be the interior of the resulting package, and is typically supplied as a single strip of zipper profile. Therefore, when the package is formed, the closure or self-mating zipper profile 70 will engage against itself around the upper interior perimeter of the package. A self-mating zipper profile is one that, when folded back upon itself, or when two identical segments are put in opposition, can be pressed together and engage in a way that typical dissimilar zipper halves are mated together. The locking members can take a variety of shapes, typically including multiple tracks, but can include such configurations as a series of posts with hooks (males), a series of U-shaped members with hooks (females), a field of mushrooms (Aplix), or hook and loop (Velcro). Closure or self-mating zipper profile 70 may extend beyond the edges of the blank 10 in order to provide material that can overlap at the opposite end of closure or zipper profile 70 in order to create a lap seal. As shown in FIGS. 3 and 4, the opposite ends 71, 73 of closure or zipper profile 70 may be interlocked and/or sealed together during formation of the package.

Similarly, the blank 12 shown in FIG. 2 includes a strip of flexible, typically polymeric, film 72 attached to the top edge of the blank 10. Film 72 may be attached on either side of blank 12, so that film 72 may be attached to the interior or exterior of the resulting package. Film 72 includes an integral or attached closure 70, such as, but not limited to, a self-mating zipper profile in a continuous one-piece configuration, above the rigid portion of the blank 12, which will be on the interior of the strip of film 72 when the package is formed, so that the self-mating zipper profile, typically provided as a single piece, will be around the interior perimeter of package and will be able to engage with itself. Film 72 may extend beyond the edges of the blank 12 in order to provide material that can overlap at the opposite end of film 72 in order to create a lap seal.

Once the closure (or zipper) 70, or film portion 72, is attached to the blank 10 or 12, the container can be folded to construct a box shape. The top can be sealed closed, or the bottom folded and sealed closed. Additionally, the top edge of blank 10 or 12 can be sealed closed if provision has been made for web flanges above the closure or zipper 70. Depending on the package style, the package can be filled through the bottom, through the opened closure or zipper 70, or by leaving a portion of the closure or zipper 70 unattached and filling between the closure or zipper 70 and one of the blank walls, and subsequently sealing the unattached portion of the closure or zipper 70 to the blank wall.

Figure 5:
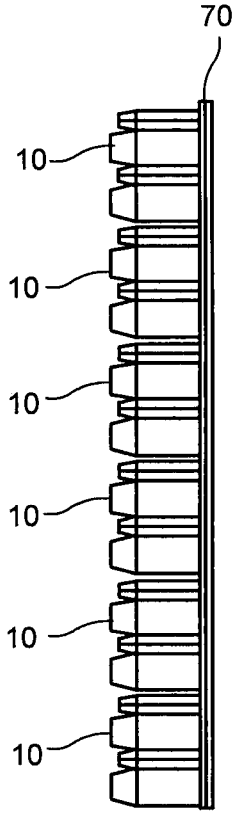
FIG. 5 is a plan view of the attachment of a continuous zipper strip to a series of box blanks that are configured side-to-side.

Additionally, FIG. 5 illustrates how a continuous zipper strip 70 (or closure strip) can be attached to a series of blanks 10 that are connected side-by-side.

This design greatly simplifies the manufacturing process and allows the zipper to be attached while the blank is in its flat unfolded state. This construction also allows for the possibility of forming a gusset in the flexible portion of the package to match the side walls of the rigid portion.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A blank for forming a package, comprising:

a sheet of rigid or semi-rigid material which includes folds in a first direction defining a front panel, a rear panel, and first and second side panels, and which further includes at least one fold in a second direction defining at least one floor panel, wherein the first side panel includes a first gusset which is formed from first front and rear gusset panels, and the second side panel includes a second gusset which is formed from second front and rear gusset panels; and a self-mating closure profile attached to the sheet of rigid or semi-rigid material, wherein the self-mating profile has a continuous one-piece configuration and, when folded back upon itself or presented with an identical profile, can be pressed together so as to mate.

2. The blank of claim 1 wherein the first direction is perpendicular to the second direction.

3. The blank of claim 1 wherein a first side of the blank includes a tab for joinder to a second side of the blank, thereby forming a storage space of a container.

4. The blank of claim 3 wherein the tab is formed on a side of the rear panel and is for joinder to one of the first and second rear gusset panels.

5. The blank of claim 1 wherein the self-mating closure profile is a one-piece zipper profile.

6. The blank of claim 3 wherein the zipper profile is on an interior of the resulting package when the tab on the first side of the blank is joined to the second side of the blank.

7. The blank of claim 1 wherein the blank is made from a material chosen from the group consisting of paper, cardboard, fiberboard, chipboard and plastic.

8. The blank of claim 1 wherein the sheet of material is a single integral sheet of material.

9. The blank of claim 1 wherein the at least one floor panel is folded to create a floor for a resulting container.

10. A blank for forming a package, comprising:

a sheet of rigid or semi-rigid material which includes folds in a first direction defining a front panel, a rear panel, and first and second side panel, and which further includes at least one fold in a second direction defining at least one floor panel, wherein the first side panel includes a first gusset which is formed from first front and rear gusset panels, and the second side panel includes a second gusset which is formed from second front and rear gusset panels; and a web of polymeric material attached to the sheet of material, further including a self-mating closure profile attached to the web of polymeric material, wherein the self-mating profile has a continuous one-piece configuration and, when folded back upon itself or presented with an identical profile, can be pressed together so as to mate.

11. The blank of claim 10 wherein the first direction is perpendicular to the second direction.

12. The blank of claim 10 wherein a first side of the blank includes a tab for joinder to a second side of the blank, thereby forming a storage space of a container.

13. The blank of claim 12 wherein the tab is formed on a side of the rear wall and is for joinder to one of the first and second rear gusset panels.

14. The blank of claim 10 wherein the self-mating closure profile is a one-piece zipper profile.

15. The blank of claim 12 wherein the zipper profile is on an interior of the web of polymeric material of the resulting package when the tab on the first side of the blank is joined to the second side of the blank.

16. The blank of claim 10 wherein the blank is made from a material chosen from the group consisting of paper, cardboard, fiberboard, chipboard and plastic.

17. The blank of claim 10 wherein the sheet of material is a single integral sheet of material.

18. The blank of claim 10 wherein the at least one floor panel is folded to create a floor for a resulting container.

* * * * *